US006287352B1

(12) United States Patent
Littecke et al.

(10) Patent No.: US 6,287,352 B1
(45) **Date of Patent: *Sep. 11, 2001**

(54) METHOD FOR MANUFACTURING INSERTS WITH HOLES FOR CLAMPING

(75) Inventors: Peter Littecke, Huddinge (SE); David Den Boer, Pleasant Grove; Scott M. Packer, Alpine, both of UT (US)

(73) Assignee: Smith International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/097,665

(22) Filed: Jun. 16, 1998

(30) Foreign Application Priority Data

Jul. 8, 1997 (SE) ..... 9702661

(51) Int. Cl.[7] ..... B24D 3/04

(52) U.S. Cl. ..... 51/309; 51/307; 264/313; 264/317; 419/5

(58) Field of Search ..... 501/309; 419/5; 264/607, 608; 51/307, 313, 317

(56) References Cited

U.S. PATENT DOCUMENTS

| | | | |
|---|---|---|---|
| 3,743,489 | 7/1973 | Wentorf, Jr. et al. . | |
| 3,745,623 | 7/1973 | Wentorf, Jr. et al. . | |
| 4,525,179 | 6/1985 | Gigi . | |
| 5,115,697 | 5/1992 | Rodriguez et al. . | |
| 5,598,621 | 2/1997 | Littecke et al. . | |
| 5,676,496 | 10/1997 | Littecke et al. . | |
| 6,120,570 * | 9/2000 | Packer et al. | 51/309 |

FOREIGN PATENT DOCUMENTS

| | | |
|---|---|---|
| 408531 | 1/1991 | (EP) . |
| 62-10201 | 1/1997 | (JP) . |
| 96/33830 | 10/1996 | (WO) . |

* cited by examiner

*Primary Examiner*—James Derrington
(74) *Attorney, Agent, or Firm*—Burns, Doane, Swecker & Mathis, L.L.P.

(57) ABSTRACT

A method wherein a superhard abrasive material is sintered and simultaneously bonded to a sintered cemented carbide body inside a container under elevated pressure and temperature conditions (HP/HT-treatment), whereby said cemented carbide body is in contact with at least one other cemented carbide body which after the sintering is removed, is disclosed. At least the cemented carbide surfaces in contact with each other during the HP/HT-treatment is at least one coated with a 1–10 μm thick layer of a refractory oxide. The method is particularly applicable for making cemented carbide cutting inserts provided a superabrasive material and with a hole for clamping to a tool holder whereby said hole is filled with a cemented carbide plug during the HP/HT-treatment and removed thereafter. Preferably, both the plug and the insert blank are coated.

12 Claims, 1 Drawing Sheet

METHOD FOR MANUFACTURING INSERTS WITH HOLES FOR CLAMPING

BACKGROUND OF THE INVENTION

The present invention relates to the high pressure/high temperature (HP/HT) process for making polycrystalline diamond or cubic boron nitride cutting inserts. More particularly, the invention relates to certain modifications in the HP/HT process which results in cutting inserts with improved production economy and clamping possibilities.

For machining of several non-ferrous alloys like brass, magnesium and aluminum, diamond is the best tool material whereas cubic boron nitride (cBN) is very well suited for machining hardened steel, chilled cast iron and cast iron at elevated speeds.

The inserts used in such operations are either so-called PCD (polycrystalline diamond compact) or PcBN (polycrystalline cubic boron nitride compact) comprising a cemented carbide body with a diamond or cBN layer applied at such high temperature and pressure where diamond or cBN is the stable phase or the inserts are provided with diamond or cBN bodies in at least one corner or along an edge generally fastened by brazing.

The method for manufacturing such inserts has been described in, e.g., U.S. Pat. Nos. 3,745,623, 3,743,489, 4,525,179, 5,598,621 and 5,676,496.

Many inserts used for machining have holes in the center to ensure the best possible clamping to the tool holder. In case of brazed inserts, this can be achieved by brazing a PCD/cBN tip to a body that already has a hole in it. Otherwise, the hole has to be cut afterwards which is costly since cutting usually involves electro discharge machining (EDM).

U.S. patent application Ser. No. 08/601,631 discloses a method of making a cutting insert with a hole for clamping to a tool holder wherein a superhard abrasive material is sintered and simultaneously bonded to a sintered cemented carbide body with a hole inside a container under elevated pressure and temperature conditions. During sintering, the hole is filled with a plug which after sintering is removed. The plug may consist of a refractory metal, cemented carbide or cemented carbide surrounded by a sleeve of a refractory metal. The refractory metal is preferably niobium. The disadvantage with this method is that the refractory metal cannot withstand the high pressure and temperature resulting in cracks in the cemented carbide insert.

OBJECTS AND SUMMARY OF THE INVENTION

It is an object of this invention to avoid or alleviate the problems of the prior art.

It is further an object of this invention to provide a process for making polycrystalline diamond or cubic boron nitride cutting inserts.

It is an aspect of the invention to provide a method for sintering and bonding a superhard abrasive material to a sintered cemented blank comprising

- placing a sintered cemented blank within a container in contact with at least one other cemented carbide body, at least one of said blank and body being coated with a 1–10 $\mu$m thick layer of a refractory oxide,
- adding a superhard abrasive material powder to the container in contact with at least a portion of the said body, and
- subjecting the resultant assembly to an elevated temperature and pressure conditions to simultaneously sinter the superhard abrasive material and bind it to the sintered cemented carbide blank.

BRIEF DESCRIPTION OF THE DRAWINGS

The FIGURE is a sectional view of the HP/HT cell as modified by the improvement of the present invention.

DETAILED DESCRIPTION OF THE PREFERRED EMBODIMENTS OF THE INVENTION

Figure 1:
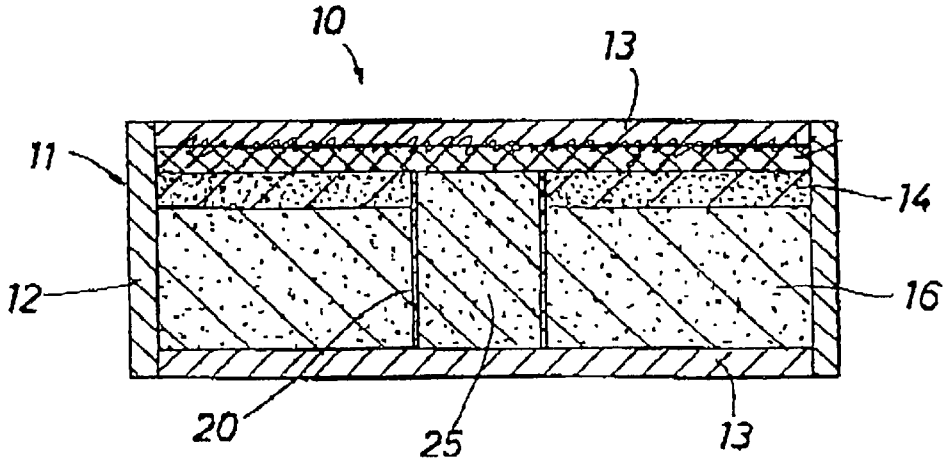

According to the presently claimed invention, making the hole is accomplished by providing a cemented carbide insert blank with a hole. During the HP/HT-treatment, the hole is provided with a plug consisting of cemented carbide. The plug and/or cemented carbide blank are provided with a thin coating of a refractory oxide. After the HP/HT-treatment, the plug is easily removed by mechanical pressure and the blank is ground to final shape and dimension.

Techniques for simultaneously applying both high pressure and high temperature in this type of apparatus are well-known in the art. Referring now to the Figure, the HP/HT-cell 10 fits within the space in the apparatus subjected to HP/HT-conditions. The assembly consists of a can 11 comprising a cylindrical sleeve 12 and caps 13 of shield metal selected from a group consisting of Zr, Ti, Ta, Nb and Mo.

A sintered and coated cemented carbide insert blank 16 with a hole in it is placed in the cup 12. The hole can be cylindrical but it can also have other shapes such as completely or partly tapered or chamfered on one or both sides. The hole is provided with a plug 25 with the same geometry as the hole. In order to avoid undesired sintering between the plug and cemented carbide blank, the plug is coated with a thin $Al_2O_3$-layer 20, but a thin $Al_2O_3$-layer can also be provided onto the cemented carbide blank in order to avoid undesired surface reactions between cemented carbide and the refractory material of the cell. This thin $Al_2O_3$-layer is 1–10 $\mu$m, preferably 2–8 $\mu$m, most preferably about 5 $\mu$m thick. Preferably both the plug and cemented carbide blank are coated. Preferably, the plug consists of a cemented carbide with essentially the same composition as that of the cemented carbide 16 blank.

A mixture containing diamond or cBN powder is filled into the cell, e.g., so as to form a top layer 14, or in grooves as disclosed in U.S. Pat. Nos. 5,598,621 and 5,676,426, or in any other desirable way. The cell is closed and placed in the HP/HT apparatus. The pressure and temperature is increased to the area where diamond or cBN is stable for a sufficient time for sintering to occur. The charge is then allowed to cool under pressure for a short period of time and after the pressure is relieved, the compact is recovered.

The plug can be removed by applying mechanical pressure. Finally, the compact is ground to desired final shape, e.g., circular, triangular or square, and dimension.

The invention has been described with reference to the making of an insert with a hole. It is obvious that the method can also be applied to other cases where the sintering together of two or more cemented carbide parts during a HP/HT-treatment or other surface reactions between components in a high pressure cell assembly shall be avoided. Instead of $Al_2O_3$, other refractory oxides such as $Y_2O_3$, $ZrO_2$ can be used.

The invention is additionally illustrated in connection with the following Example which is to be considered as illustrative of the present invention. It should be understood, however, that the invention is not limited to the specific details of the Example.

Example

A cemented carbide cylindrical disc with composition WC+16 wt-% Co with diameter of about 22 mm, thickness 6 mm and a tapered central hole with a diameter of 4 mm and with four grooves located equidistantly along the peripheral surface of the disc was prepared. The grooves had an essentially semicircular cross-section with a diameter of about 4 mm. The cemented carbide disc was placed in a cup of Nb. Into the hole of the disc, a plug of a 5 mm diameter cemented carbide plug with composition WC+16% Co coated with a 5 $\mu$m layer of $Al_2O_3$ was squeezed. The grooves were filled with a cBN powder mixture with a composition corresponding to Megadiamond commercial grade MN50 and after that, the container was sealed and treated at high temperature and high pressure according to the process described in U.S. Pat. No. 5,115,697. After cooling, the compact was recovered. The plug was removed by applying a slight mechanical pressure. The disc was then ground to inserts style WNGA 080408 with a central hole that could flinly be clamped to a tool holder.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method for sintering and bonding a superhard abrasive material to a sintered cemented carbide blank comprising placing a sintered cemented carbide blank within a container in contact with at least one other cemented carbide body, at least one of said blank and body being coated with a 1–10 $\mu$m thick layer of a refractory oxide, adding a superhard abrasive material powder to the container in contact with at least a portion of the body, and subjecting the resultant assembly to an elevated temperature and pressure condition to simultaneously sinter the superhard abrasive material and bind it to the sintered cemented carbide blank.

2. The method of claim 1 wherein said cemented carbide blank is a cutting insert blank with a hole for clamping to a tool holder and said at least one other cemented carbide body is a cemented carbide plug filling said hole during sintering after which the plug is removed and the blank ground to an insert of final shape and dimension.

3. The method of claim 2 wherein both insert and plug are coated with a layer of a refractory oxide.

4. The method of claim 2 wherein the cemented carbide of the plug has essentially the same composition as that of the cutting insert blank.

5. The method of claim 1 wherein said refractory oxide is $Al_2O_3$, $Y_2O_3$ or $ZrO_2$.

6. The method of claim 1 wherein a centrally-located through hole is formed in the blank.

7. The method of claim 6, wherein the centrally-located through hole is the only hole formed in the blank.

8. The method of claim 7, wherein the body fills the through hole during sintering.

9. The method of claim 1, wherein the layer of refractory oxide is approximately 2–8 $\mu$m thick.

10. The method of claim 1, wherein the layer of refractory oxide is approximately 5 $\mu$m thick.

11. The method of claim 1, wherein the superhard abrasive material comprises polycrystalline diamond or polycrystalline cubic boron nitride.

12. The method of claim 1, wherein the blank is separated from the body by the refractory oxide layer.

* * * * *

UNITED STATES PATENT AND TRADEMARK OFFICE

CERTIFICATE OF CORRECTION

PATENT NO. : 6,287,352 B1
DATED : September 11, 2001
INVENTOR(S) : Peter Littecke et al.

It is certified that error appears in the above-identified patent and that said Letters Patent is hereby corrected as shown below:

Title page,
Item [73], Assignee, please insert -- SANDVIK AB, Sandviken, Sweden --.

Signed and Sealed this

Twenty-ninth Day of January, 2002

*Attest:*

*Attesting Officer*

JAMES E. ROGAN
*Director of the United States Patent and Trademark Office*